United States Patent [19]

Okada

[11] Patent Number: 4,765,157

[45] Date of Patent: Aug. 23, 1988

[54] METHOD AND APPARATUS FOR ROLLING UP FABRIC FOR CIRCULAR KNITTING MACHINE

[75] Inventor: Toshihiko Okada, Kyoto, Japan

[73] Assignee: Gunze Limited, Ayabe, Japan

[21] Appl. No.: 11,501

[22] Filed: Feb. 5, 1987

[30] Foreign Application Priority Data

Aug. 23, 1986 [JP] Japan ..... 61-197843

[51] Int. Cl.[4] ..... D04B 15/88

[52] U.S. Cl. ..... 66/151

[58] Field of Search ..... 66/149 R, 151; 139/304; 242/56.1, 62, 81

[56] References Cited

U.S. PATENT DOCUMENTS

| | | | |
|---|---|---|---|
| 3,097,806 | 7/1963 | Darman | 242/56.1 X |
| 3,201,056 | 8/1965 | Fanning | 242/56.1 |
| 3,839,885 | 10/1974 | Bourgeois | 66/151 |
| 4,079,600 | 3/1978 | Amaya et al. | 66/151 X |
| 4,105,172 | 8/1978 | Petros | 242/81 X |

FOREIGN PATENT DOCUMENTS

| | | | |
|---|---|---|---|
| 2327531 | 12/1974 | Fed. Rep. of Germany | 66/149 R |
| 59-88955 | 5/1984 | Japan . | |

*Primary Examiner*—W. Carter Reynolds

*Attorney, Agent, or Firm*—Sixbey, Friedman, Leedom & Ferguson

[57] ABSTRACT

A rolling-up apparatus disposed below the knitting unit of a circular knitting machine has a pair of support frames rotatable and stoppable in synchronism with the knitting unit. A take-up spool, having a pair of spool members subdividing it lengthwise, is supported by the support frames and is rotatable about a horizontal axis. The spool members are advanced to a rolling-up position to clamp the leading end of the fabric and then rotated to roll up the fabric thereon. The spool members are withdrawn from the rolled-up fabric, which is then delivered from the knitting machine. The spool members are advanced again to the rolling-up position to roll up the subsequent portion of fabric, after part of it has been deflected into the path of the path of the spool members by a fabric shifting member.

14 Claims, 12 Drawing Sheets

63
64
66
67
69
70
71
72
73
74
75
79
81
82
10
31
50
52
54
49
76
80
8
B
C
D
62

42
43
100
101
103
25B
F
E
31A
40
90
23
24
16
6
6A
11
31
91
49
50

METHOD AND APPARATUS FOR ROLLING UP FABRIC FOR CIRCULAR KNITTING MACHINE

FIELD OF THE INVENTION AND RELATED ART STATEMENT

The present invention relates to a method of and an apparatus for rolling up the fabric delivered in a hanging form from a circular knitting machine.

The tubular fabric knitted by a circular knitting machine is delivered downward from the machine through the center of the lower needle bed and rolled up on the take-up spool of a take-up motion disposed below the knitting machine and rotatable in synchronism therewith as proposed, for example, in Unexamined Japanese Patent Publication SHO No. 59-88955.

A plurality of slender take-up spools are prepared for the conventional rolling-up method and apparatus. The fabric delivered in a hanging form from the circular knitting machine is rolled up on one of the take-up spools which is placed in the rolling-up position, by engaging the leading end of the fabric with card clothing on the spool or holding the end by a clamp member provided separately from the spool and rotating the take-up spool in the rolling-up direction about its axis.

When the fabric is fully wound on the spool, the roll including the spool is allowed to fall onto a dolly positioned below the rolling-up position and then delivered to the next process. On the other hand, another one of the spools prepared for the rolling-up apparatus is automatically fed to the rolling-up position by a spool guide.

The prior art described has the following problems.

The leading end of the fabric is engaged with the card clothing on the take-up spool or held by the separate clamp member and is thereby held to the spool, which therefore can not be withdrawn from the roll of fabric. Accordingly, the roll must be delivered from the knitting machine along with the take-up spool with much labor. Further because the subsequent portion of fabric needs to be rolled up on the next spool quickly from the viewpoint of operation efficiency, it is necessary to prepare a plurality of take-up spools and to feed the spool to the rolling-up position.

In order to automatically feed the take-up spool to the rolling-up position of the rolling-up apparatus, the circular knitting machine must be stocked with many take-up spools. This is not only uneconomical but requires additional care for stocking.

If the circular knitting machine develops a trouble, the machine and the rolling-up apparatus must be brought out of operation immediately, whereas the apparatus, when stocked with additional take-up spools, is difficult to stop immediately owing to their weight involving inertia and requires a longer period of time before stopping. The provision of the spool guide on the rolling-up apparatus further lengthens the required time.

OBJECTS AND SUMMARY OF THE INVENTION

An object of the invention is to provide a rolling-up method using an apparatus disposed below a circular knitting machine and having a take-up spool rotatable in synchronism therewith, the take-up spool comprising a pair of spool members movable on a common axis into or out of a position for rolling up the fabric delivered from the machine, the method being characterized by positioning the fabric across the axis of the spool members in the rolling-up position, advancing the spool members to the rolling-up position to clamp the leading end of the fabric across the axis with the spool members from the opposite sides of the fabric and rotating the spool members about the axis to roll up the fabric.

Another object of the invention is to provide a fabric rolling-up apparatus of the type described wherein although the take-up spool comprising the pair of spool members is subjected to a thrust force acting to move the spool members away from each other as the fabric is rolled up thereon, the thrust force can be withstood properly, permitting the take-up spool to rotate smoothly in the rolling-up direction.

Another object of the present invention is to provide a fabric rolling-up apparatus of the type described wherein the take-up spool comprising the pair of spool members in the rolling-up position can be withdrawn from the roll of fabric on completion of rolling-up operation so that the rolled-up fabric only can be delivered from the circular knitting machine, the withdrawn spool being movable into the rolling-up position for winding the subsequent portion of the fabric.

Another object of the present invention is to provide a fabric rolling-up apparatus of the type described wherein the take-up spool comprising the pair of spool members is movable between the rolling-up position and the withdrawn position by withdrawing means which is disposed separately from the apparatus and which has an engagement portion engageable with an engaging portion formed at the outer end of each spool member so as to reduce the force of inertia during fabric rolling-up operation.

To fulfill these objects, the present invention provides a fabric rolling-up apparatus to be disposed below a circular knitting machine and adapted to be brought into and out of operation in synchronism with the machine, the apparatus having a take-up spool rotatable about its own axis for rolling up thereon the fabric delivered from the knitting machine, the take-up spool comprising a pair of spool members movable on the axis into and out of the fabric rolling-up position, the spool members being projectable into the rolling-up position to clamp the leading end of the fabric with their projected ends and being rotatable in this state about the axis to roll up the fabric.

After the fabric has been rolled up, the spool members are moved axially thereof away from each other, whereby the take-up spool is withdrawn from the roll of fabric, which is then delivered from the knitting machine to the subsequent process by a dolly.

On the other hand, the spool members of the withdrawn take-up spool are moved toward each other and advanced to the rolling-up position again to clamp the hanging leading end of the subsequent fabric portion with their projected ends.

DESCRIPTION OF THE PREFERRED EMBODIMENTS

Figure 1:
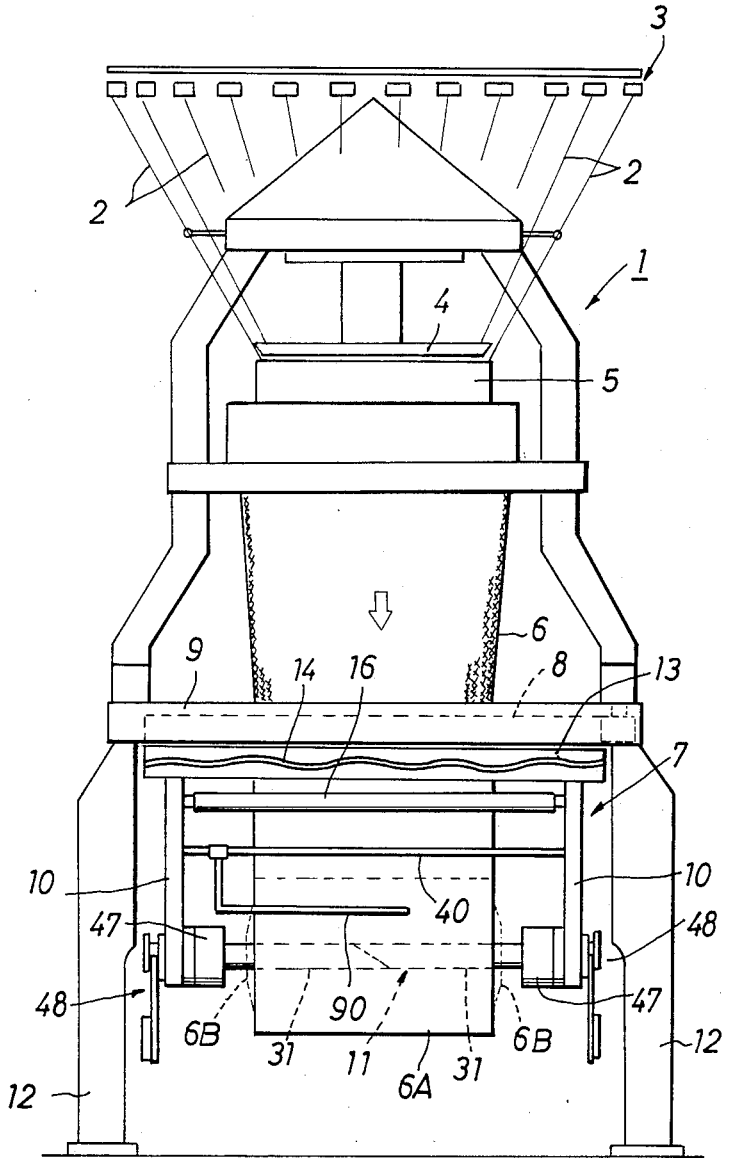
FIG. 1 is a front view showing a circular knitting machine equipped with a rolling-up apparatus.

With reference to FIG. 1, a circular knitting machine 1 comprises means 3 for feeding yarns 2, and knitting means comprising upper and lower needle beds 4 and 5 to form a tubular knitted fabric 6, which is continuously delivered downward in a hanging state.

Disposed below the knitting machine 1, i.e. below the knitting means is a rolling-up apparatus 7 which rotates about a vertical axis and stops in synchronism with the knitting means.

The rolling-up apparatus 7 comprises a base 9 incorporating a ring gear 8 rotatable on a horizontal plane, a pair of opposed support frames 10 fixed at their upper ends to the ring gear 8 and extending downward, and a take-up spool 11 rotatable about its own axis and supported horizontally by the lower ends of the support frames 10. The tubular fabric 6 is passed through the ring gear 8 and wound on the spool 11.

More specifically, the ring gear 8 of the apparatus 7 is rotated and stopped in synchronism with the knitting means of the machine 1, whereby the opposed support frames 10 are rotated and stopped, and the tubular fabric 6 continuously formed and hanging downward is rolled up without twisting on the take-up spool 11 rotated about the axis of rotation of the support frames.

The base 9 is supported by three legs 12, between which the rolled fabric can be delivered outward from the rolling-up position.

Figure 2:
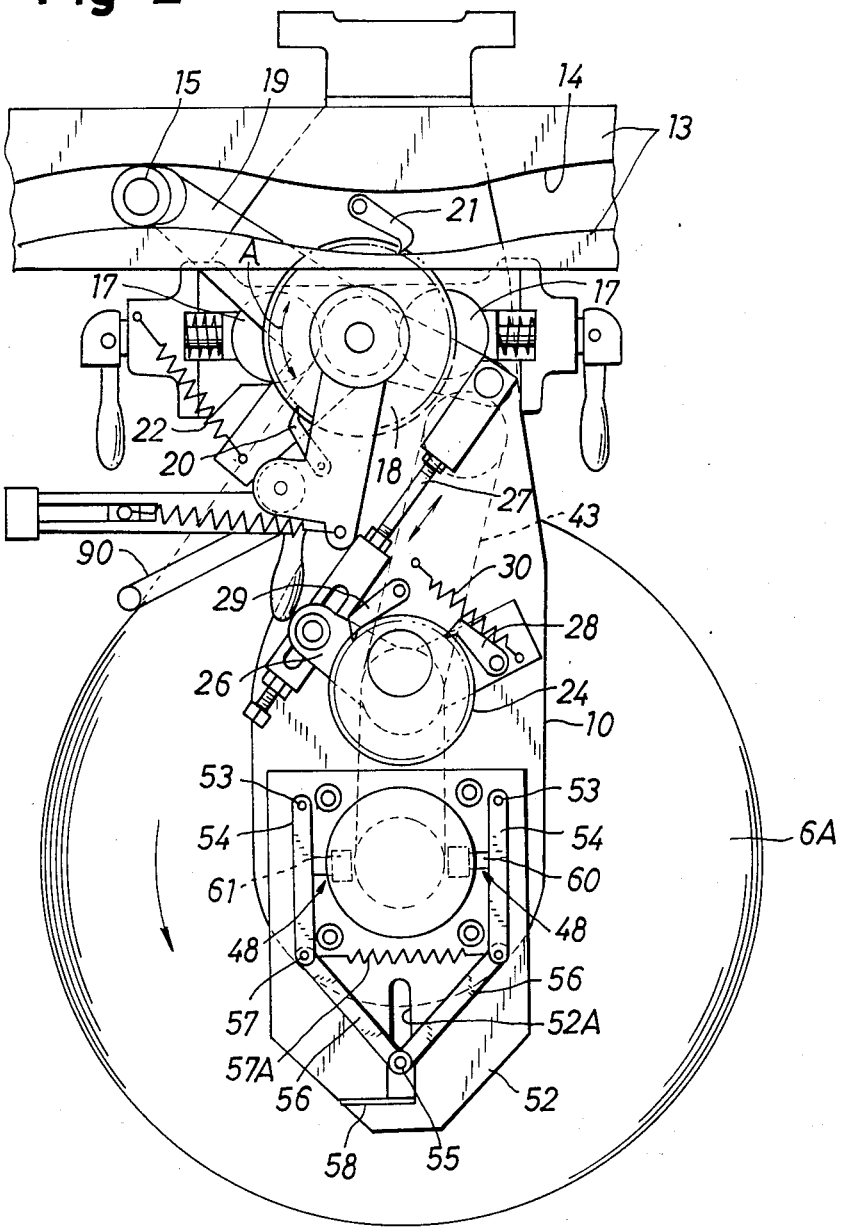
FIG. 2 is a side elevation of the rolling-up apparatus showing synchronizing transmission means.
Figure 3:
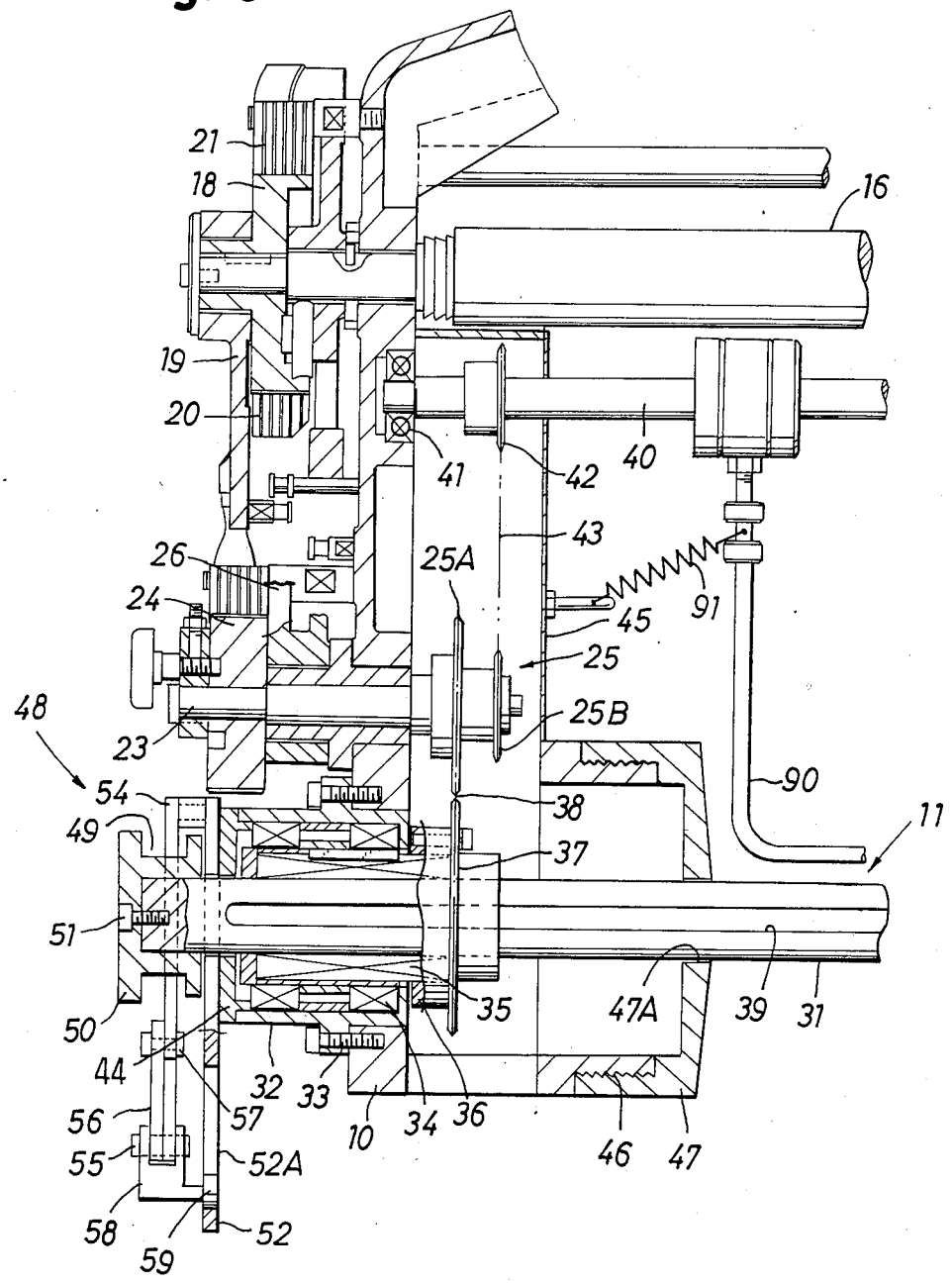
FIG. 3 is a sectional elevation of FIG. 2.

With reference to FIGS. 1 to 3, a pair of upper and lower cam rings 13 is fixed to the lower side of the base 9 and has a cam groove 14. The cam groove 14 and a cam roller 15 fitted therein which serve as means for driving the take-up spool 11 and fabric feed rolls 16.

Figure 5:
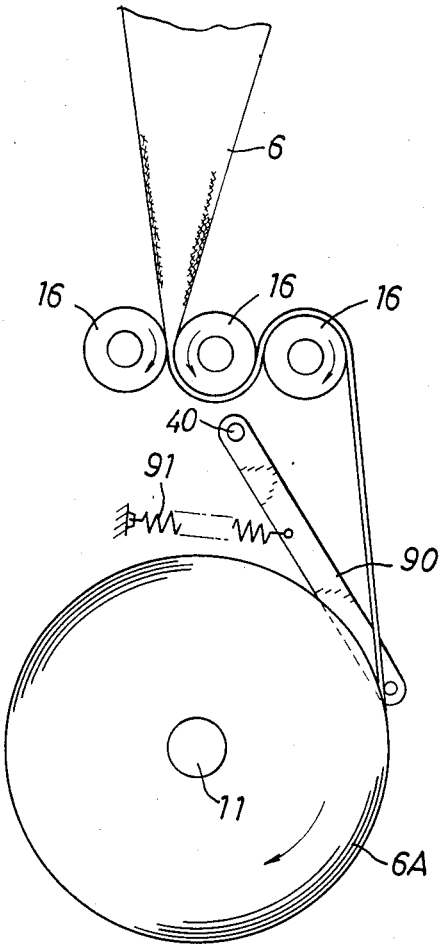
FIG. 5 is a side elevation showing the apparatus during operation.

The feed rolls 16, which are three in number, are arranged in parallel below the cam rings 13 and supported by the upper end portions of the support frames 10 as shown in FIGS. 3 and 5. The hanging fabric 6 is passed around the feed rolls 16 and thereby sent forward as shown in FIG. 5.

As shown in FIG. 2, the rolls 16 are provided, each at its one end, with gears 17 meshing with one another. The shaft end of the central roll 16 fixedly has a ratchet wheel 18. A pivotal member 19 carrying the cam roller 15 is fitted around the boss of the wheel 18 and has a pawl 20 engaging with the wheel 18 (see FIG. 2).

When the support frames 10 are rotated about the vertical axis by the ring gear 8, the cam roller 15 is guided along the groove 14 to move the pivotal member 19 upward and downward as indicated by the arrows A in FIG. 2, rotating the ratchet wheel 18 by the pawl 20 and consequently rotating the fabric feed rolls 16 through the meshing engagement of the gears 17 as seen in FIG. 5.

As shown in FIG. 2, the ratchet wheel 18 has a pawl 21 in engagement therewith for preventing reverse rotation. A spring 22 is connected between the pivotal member 19 and the support frame 10.

An intermediate transmission shaft 23 is rotatably supported by each of the two support frames 10 at an intermediate portion of its height. One of the two transmission shafts 23 is fixedly provided with a ratchet wheel 24 at its one end and an intermediate transmission member 25 including large and small two sprocket wheels 25A, 25B at the other end. The other shaft 23 has an intermediate transmission member 25 but no ratchet wheel.

The transmission shaft 23 carrying the ratchet wheel 24 has a second pivotal member 26 rotatably mounted thereon and operatively connected to the first pivotal member 19 by a coupling member 27 having a turnbuckle structure as seen in FIG. 2.

The second pivotal member 26 has a drive pawl 28 in engagement with the ratchet wheel 24, such that the movement of the first pivotal member 19 moves the second pivotal member 26 through the coupling member 27, causing the drive pawl 28 to rotate the wheel 24, which in turn rotates the transmission shaft 23.

As shown in FIG. 2, the ratchet wheel 24 has a pawl 29 for preventing reverse rotation, while a spring 30 is connected between the second pivotal member 26 and the support frame 10.

With reference to FIGS. 1, 3, 7, 11, etc., the spool shaft 11 comprises a pair of opposed spool members 31 which are supported by the lower ends of the support frames 10, axially movable on the same axis toward or away from each other between the rolling-up position and a withdrawn position and rotatable about the axis.

With reference to FIG. 3, a bearing box 32 is fixed by bolts 33 to the outer side of each support frame 10. Needle bearings 34 are axially spaced apart and accommodated in the bearing box 32. A holder 36 for ball slide bearing 35 is inserted inside the bearings 34. The spool member 31 is rotatably supported by the double bearing means, i.e. the inner slide bearing 35 and the outer needle bearings 34, on the support frame 10.

A rotary transmission member 37 which is shown as a sprocket wheel is fixed to the inner end of the holder 36. An endless chain 38 is reeved around the transmission member 37 and the sprocket wheel 25A of the intermediate transmission member 25 on the transmission shaft 23, whereby the holder 36 is made rotatable by the shaft 23 within the needle bearings 34.

Figure 6:
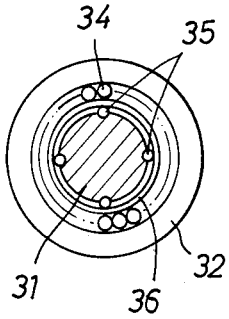
FIG. 6 is a cross sectional view showing a spool member bearing portion.

With reference to FIGS. 3 and 6, the spool member 31 is formed in its outer periphery with axial grooves 39 that are semicircular in cross section and in a radial arrangement, with the balls of the slide bearing 35 rollably fitted in the grooves 39. Thus, by the slide bearing 35 and the semicircular grooves 39, the holder is engaged with the spool member 31 with respect to the direction of rotation for the transmission of torque while rendering the spool member 31 withdrawable from the holder axially thereof.

Accordingly, the spool member 31 is rotatable in the fabric rolling-up direction and axially slidable. The slide bearing 35 and the grooves 39 serve as means for permitting torque transmission and the axial movement of the spool member.

While FIG. 3 shows only one of the spool members 31, the other member 31 in alignment therewith is rotatably and axially slidably supported on the other support frame 10 by like needle bearings 34, slide bearing 35, etc. The two spool members 31 are rotatable in the same direction at the same speed.

For this purpose, a transmission shaft 40 is disposed below the feed rolls 16 and rotatably supported by bearings 41 on the support frames 10 as shown also in FIGS. 1 and 3. A sprocket wheel 42 is mounted on each end portion of the shaft 40. An endless chain 43 is reeved around the sprocket wheel 42 and the sprocket wheel 25B of the intermediate transmission member 25. The opposed spool members 31 are therefore rotated in the same direction at the same speed.

With reference to FIGS. 1 and 3, the spool shaft rotating transmission means comprising the transmission members 25, 37, sprocket wheels 42 and chains 43 are each covered with a cover 45, to which a cap 47 in the form of a cup is attached in screw-thread engagement therewith as at 46 axially movably. The cap 47 is centrally formed with a hole 47A having the spool member 31 inserted therethrough. When the spool member 31 is drawn out from the hole 47A, the cap 47 serves as a stopper for the roll of fabric 6A. The position of the cap 47 is axially adjustable by screwing for rolling up a fabric of different width.

Figure 7:
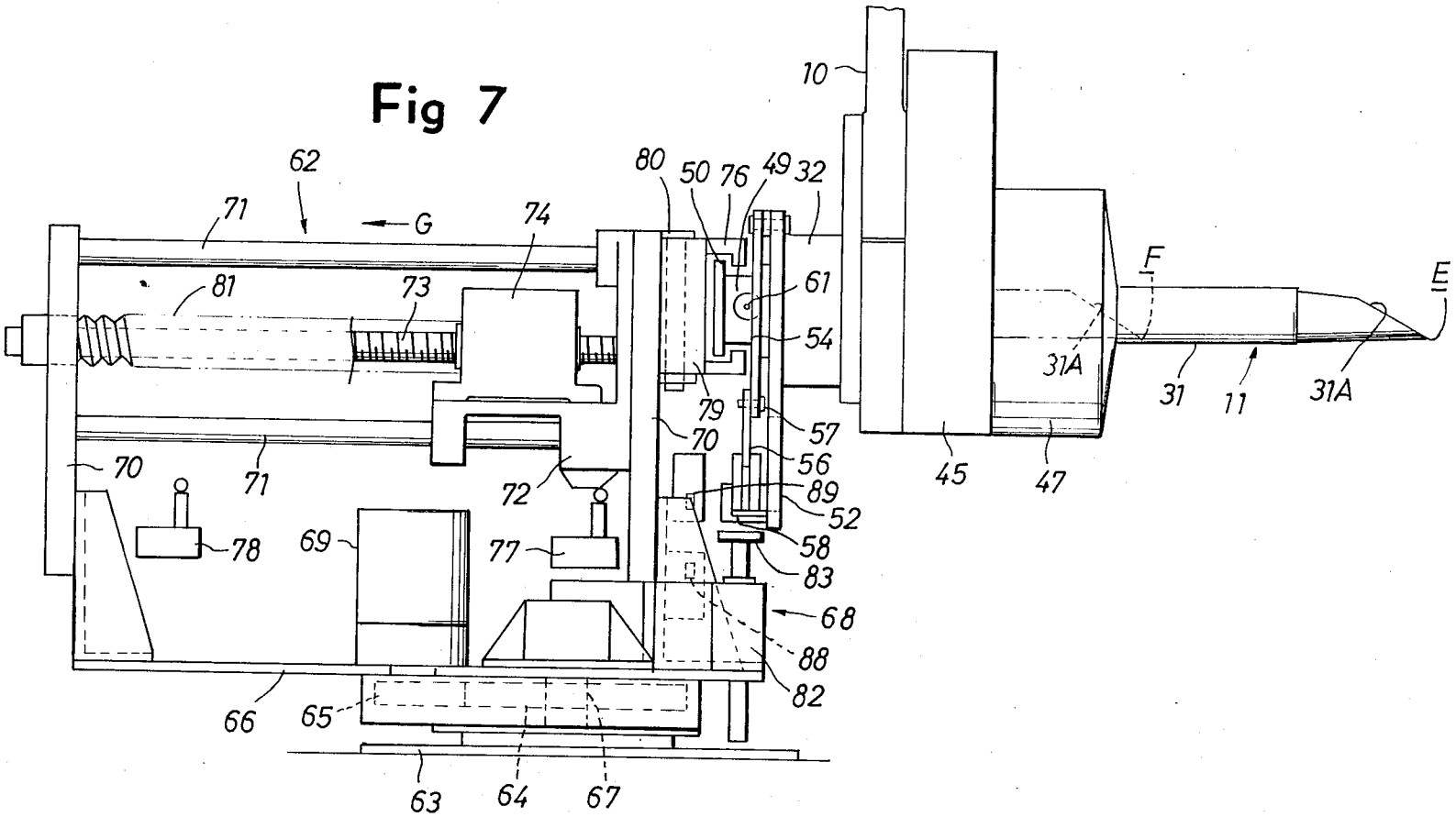
FIG. 7 is a front view showing spool member withdrawing means.

As shown in FIG. 7, the projecting end of each spool member 31 is tapered and inclined with respect to the axial direction to provide a fabric clamping face 31A. The opposed clamping faces 31A are lapped over each other when the opposed spool members 31 are advanced to the rolling-up position to form the single take-up spool 11.

Since the rolling-up apparatus 7 is rotating about a vertical axis in synchronism with the knitting machine during rolling-up, the opposed spool members 31 constituting the spool 11 are subjected to a force acting to move these members axially away from each other. To prevent this, each spool member 31 is provided with retaining means 48 at its outer end.

Figure 4:
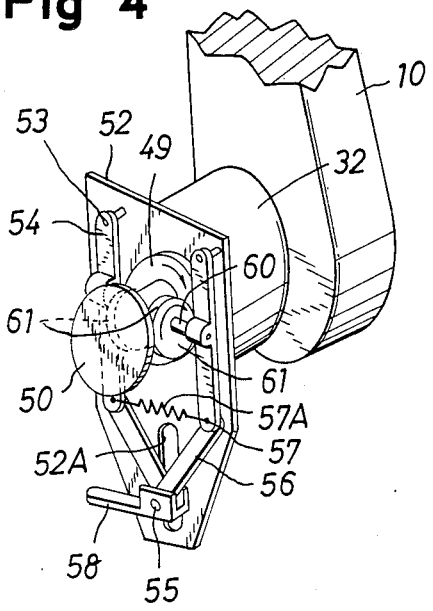
FIG. 4 is a perspective view showing spool member retaining means.

With reference to FIGS. 3 and 4, a flange member 50 having a circumferential groove 49 is fastened to the outer end of the spool member 31 with a bolt 51. A base plate 52 having a vertical guide groove 52A is fixed to a holding cover 44 of the bearing box 32.

Figure 17:
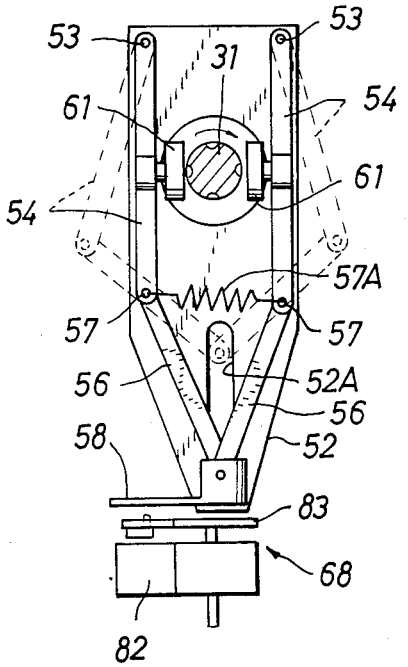
FIG. 17 is a side elevation showing the retaining means before and after operation.

A downwardly extending pair of first links 54 are each pivoted to the base plate 52 by a pin 53. Second links 56 are pivoted to the lower ends of the first links 54 by pins 57 which are biased toward each other by a spring 57A, the other second link ends being pivoted to each other by a pin 55. A bearing member 58 carrying a roller 59 mounted on the pin 55 and fitting in the guide groove 52A is vertically movable, whereby the link means comprising the pair of first links 54 and the pair of second links 56 is expandable or collapsible as shown in FIG. 17. A roller bearing 61 rotatably mounted on a pin 60 on each of the first links 54 is fitted in the circumferential groove 49 in pressing contact with the flange member 50. The bearings 61 thus retain the spool member 61 against slipping off.

Thus, the retaining means 48 consists substantially of the roller bearings 61, which reduce the resistance involved in the rotation of the spool member 31, i.e. the take-up spool 11, in the rolling-up direction during winding of the fabric. This assures the take-up spool 11 of smooth rotation.

On the other hand, each spool member 31 of the take-up spool 11 is prevented from slipping off outward axially thereof by the engagement of the roller bearings 61 with the flange member 50.

The thrust force acting on the spool member 31 outward axially thereof is the sum of a centrifugal force due to the rotation of the rolling-up apparatus 7 about the vertical axis and a thrust force resulting from the deformation of the rolled-up fabric 6A to a conical form 6B shown in FIG. 1 which occurs with the progress of rolling-up operation. Since the combined thrust force gradually increases as the fabric is rolled up, the bearings 61 diminish the resistance to reliably prevent the spool member 31 from slipping off and also render the spool member 31 smoothly rotatable in the rolling-up direction.

Figure 10:
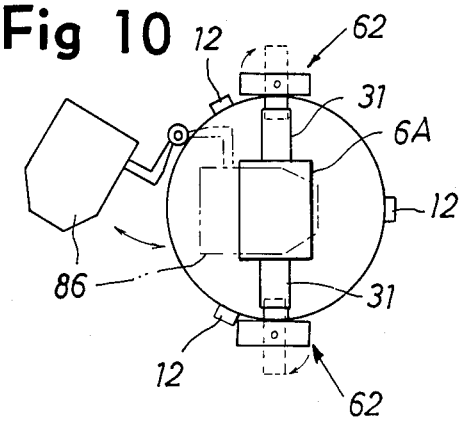
FIG. 10 is a plan view schematically showing the apparatus when a roll has been completed.

When the fabric has been fully rolled up on the spool 11 as shown in FIG. 10, the knitting machine 1 is halted, and the apparatus 7 is also stopped, whereupon the spool 11 is axially withdrawn from the roll of fabric 6A.

For this purpose, withdrawing means 62 are arranged as an opposed relationship relative to each other outside the knitting machine 1 in corresponding relation to the pair of spool members 31 (see FIG. 10).

Figures 8, 9:
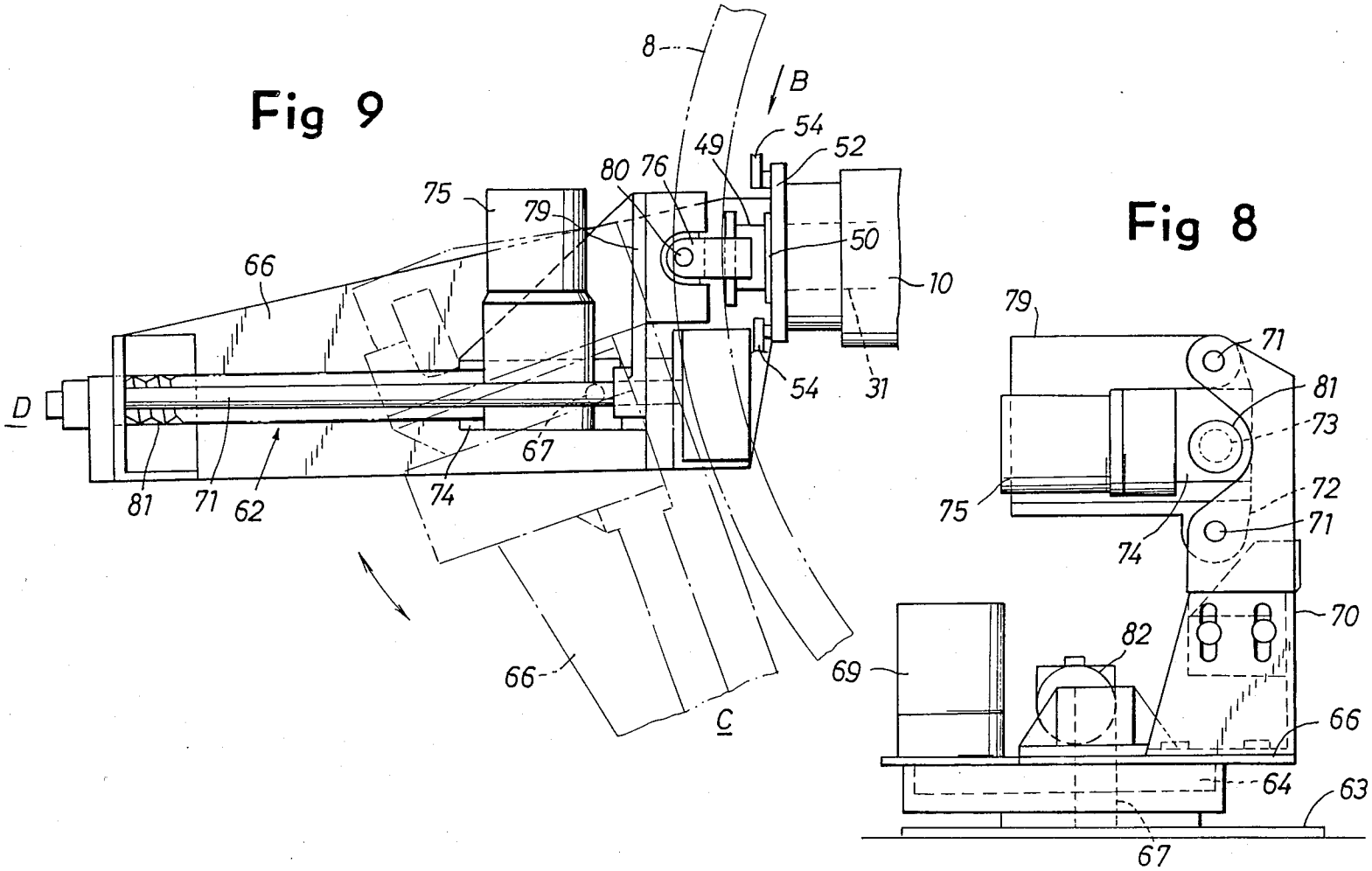
FIG. 8 is a side elevation of the same.
FIG. 9 is a plan view showing the same in operation.

Each withdrawing means 62 is shown in FIGS. 7 to 9. As seen in FIGS. 7 and 8, a swivel table 66 that is turnable about a swivel shaft 67 and mounted on an installation base 63 has swiveling means comprising a ring gear 64 and a pinion 65 meshing therewith. Mounted on the swivel table 66 are release means 68 for the retaining means 48 and the spool member withdrawing means 62. The pinion gear 65 is reversibly rotatable by a swivel motor 69.

Opposed tie rods 70 are fixedly mounted on the swivel table 66 and are interconnected by upper and lower tie rods 71. A slider 72 is mounted on these tie rods 71 and is slidable axially thereof.

A screw rod 73 disposed between the tie rods 71 in parallel therewith is connected to the slider 72. A transmission member 74 internally threaded is mounted on the screw rod 73. The transmission member 74, when driven by a motor 75 having a reduction gear, slidingly moves the slider 72 straight on the tie rods 71 axially thereof. The slider 72 carries a hook member 76. When the motor 75 is started with the hook member 76 in engagement with the flange member 50 on the spool member 31 as shown in FIG. 7, the spool 31 is moved forward or rearward by the transmission member 74 between the rolling-up position E and the withdrawn position F shown in FIG. 7. The advanced and retracted positions of the spool member 31 are detected by microswitches 77 and 78 which are actuated by the slider 72 to change the direction of rotation of the motor 75.

As seen in FIGS. 8 and 9, the hook member 76 is pivoted by a pin 80 to a projection 79 on the slider 72 so as to be engageable with or disengageable the flange member 50 smoothly.

The screw rod 73 is covered with a stretchable cover 81.

The release means 68 mounted on the swivel table 66 comprises a pusher 83 which is movable upward or downward by the forward or reverse rotation of a motor 82. The bearing member 58 of the retaining means 48 can be forced up by the pusher 83 against the return spring 57A.

Slightly before the fabric 6 hanging from the knitting means is rolled up on the take-up spool 11 to a full extent, the knitting machine 1 and the rolling-up apparatus 7 are gradually slowed down and halted in position, whereupon the swivel table 66 in a stand-by position C is swiveled to the position D shown in FIG. 9 to engage the hook member 76 with the flange member 50, and the pusher 83 is positioned below the bearing member 58 as opposed thereto.

In this state, the pusher 83 is raised to expand the link means as shown in FIG. 17 against the spring 57A to release the flange member 50 from the roller bearings 61. With the spool member 31 thus allowed to move outward axially thereof, the slider 72 is slidingly moved straight in the direction of arrow G in FIG. 7. In this way, each spool member 31 is shifted from the rolling-up position E to the withdrawn position F. Consequently, the take-up spool 11 is withdrawn from the roll of fabric 6A (see FIG. 11).

Figure 11:
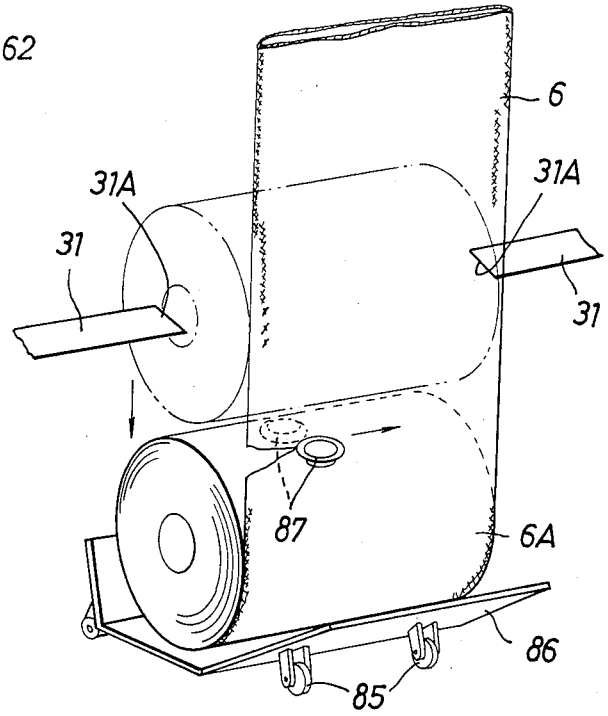
FIG. 11 is a perspective view showing a fabric being cut.

Before the spool 11 is withdrawn from the fabric roll 6A, a dolly 86 having wheels 85 is positioned immediately below the rolling-up position, and the rolled-up fabric 6A is allowed to fall onto the dolly 86 as shown in FIG. 11 and as conventionally done. After the fabric has been completely rolled up as at 6A, the fabric is cut with a pair of cutter members 87 as shown in FIG. 11 and as conventionally practiced. The roll 6A is transported by the dolly 86 for subsequent processing outside the knitting machine.

Indicated at 88 and 89 in FIG. 7 are switch members for the release means 68.

Figure 13:
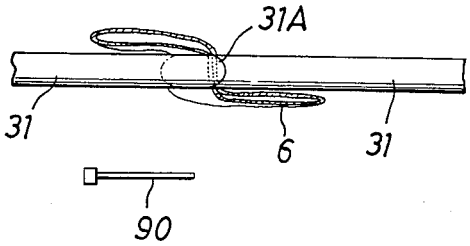
FIGS. 12 and 13 are plan views showing the leading end of fabric before and after it is clamped.

After the fabric has been cut, the leading end of the subsequent fabric portion will be clamped between the clamp faces 31A of the projecting ends of the pair of spool members 31. For this purpose, a fabric shifting member 90 is rotatably mounted on the shaft 40 as seen in FIG. 3. As can be seen in FIGS. 1–3, fabric shifting member 90 has an elongated fabric contacting arm portion extending parallel to the take-up spool members 31 along only a portion of a winding surface of the members 31 and at a position that is located, heightwise, between the spool members 31 and the knitting machine 1. The member 90 is held pressed against the fabric 6 being rolled up by a spring 91 and follows the diametric surface of the wound fabric. Accordingly, upon cutting of the fabric, the member 90 is shifted to the position shown in FIG. 12 by the spring 91 to position the hanging fabric 6 across the axis of the spool members 31. The members 31 are advanced toward each other to the rolling-up position E with the fabric positioned across their axis, with the result that the leading end of the fabric is clamped by the clamp faces 31A of the members 31 from both sides as seen in FIG. 13.

With the fabric thus held clamped, the apparatus 7 is rotated with the knitting machine 1 again, and the take-up spool 11 is also rotated, whereby the fabric is continuously rolled up.

During the rolling-up operation thus resumed, the swivel table 66 is returned from the position D to the position C in FIG. 9. Thus, the withdrawing means 62 will not project greatly outside the knitting machine 1.

Figure 14:
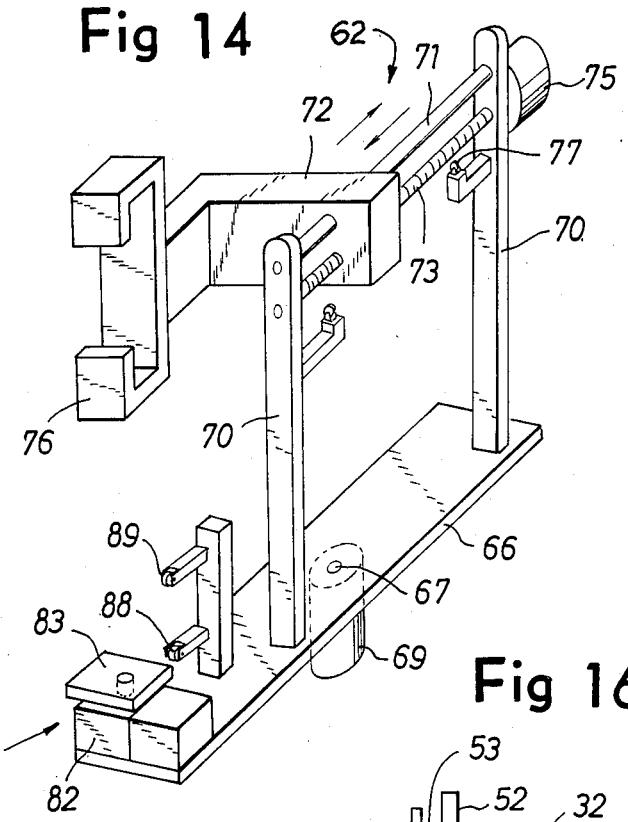
FIG. 14 is a perspective view schematically showing the withdrawing means.
Figure 15:
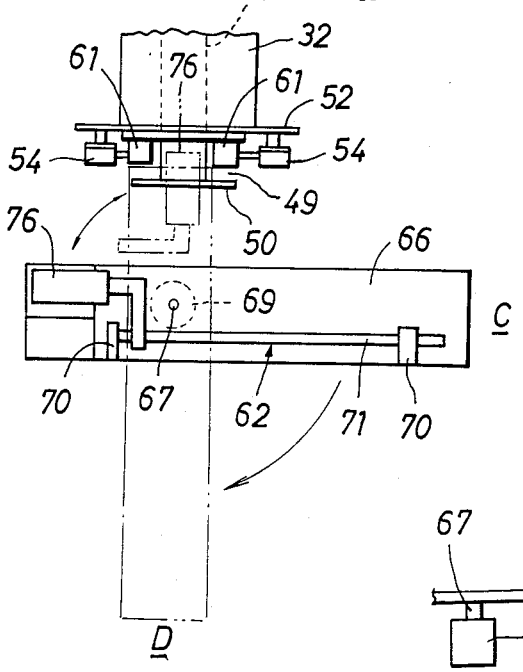
FIG. 15 is a plan view showing the same.
Figure 16:
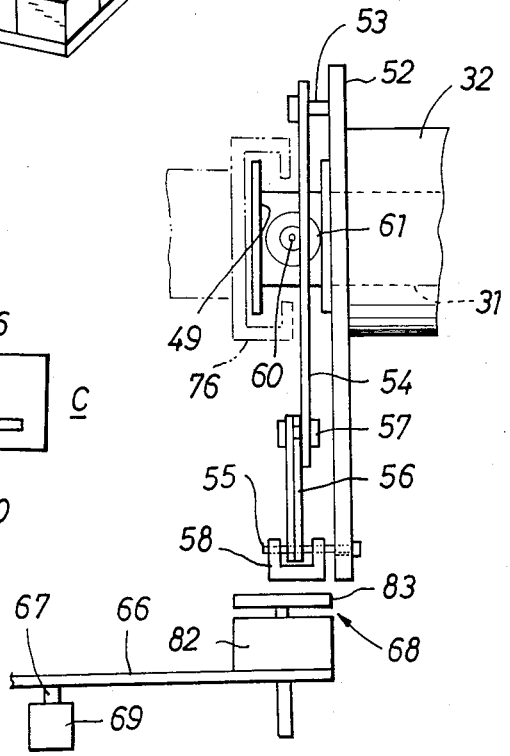
FIG. 16 is a front view showing the same.

FIGS. 14 to 16 schematically show the spool withdrawing means, etc. Throughout FIGS. 1 to 17 like parts are referred to by like reference numerals.

A swivel table 66 is swivelably mounted on the shaft 67 of a swivel motor 69. Frames 70 extend upward from the swivel table 66. Tie rods 71 and a screw rod 73 arranged in parallel with one another are supported by the frames 70. The screw rod 73 is driven by a motor 75. A slider 72 carrying a hook member 76 is mounted on the tie rods 71 and the screw rod 73. The slider 72 is reciprocatingly slidingly movable by the motor 75. A pusher 83 is movable upward or downward by a lift motor 82 mounted on one end of the swivel table 66.

Figure 20:
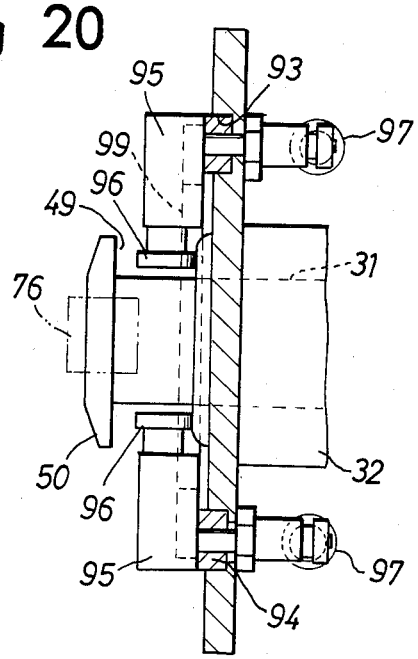
FIG. 20 is a plan view of the same.
Figure 18:
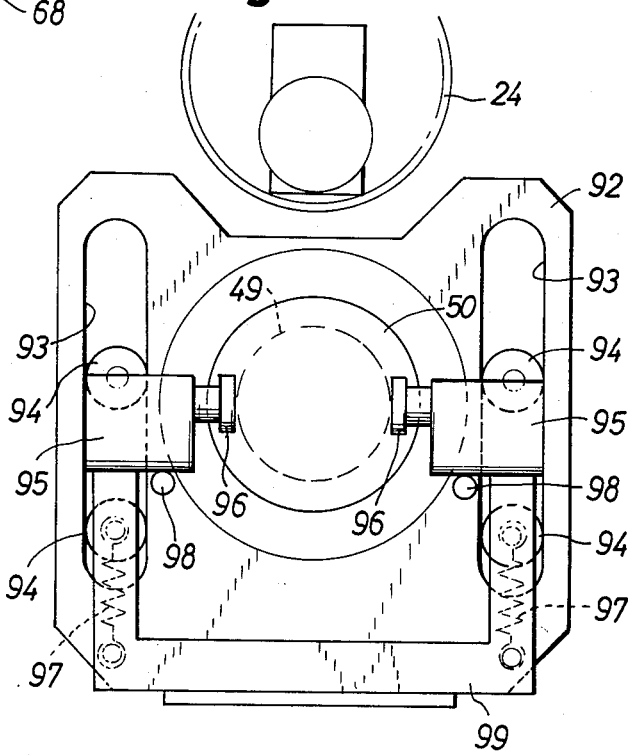
FIG. 18 is a side elevation showing another example of retaining means.
Figure 19:
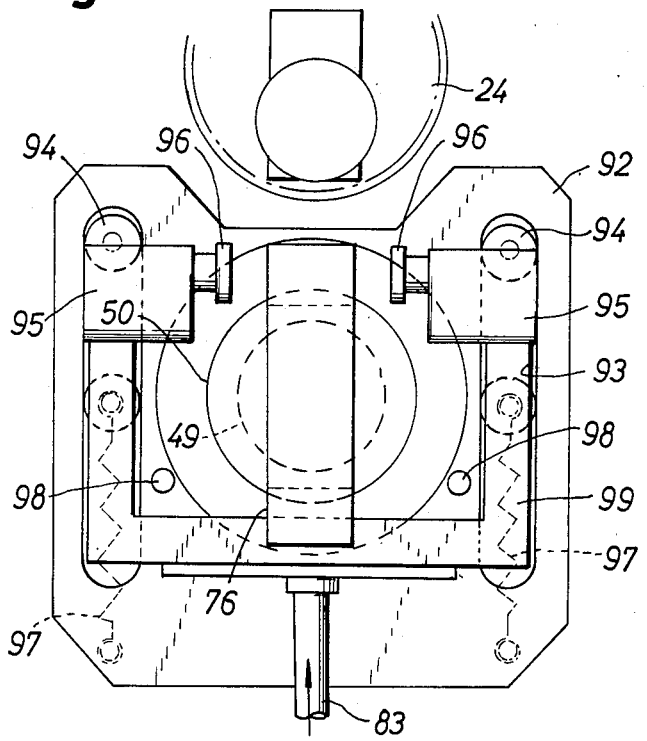
FIG. 19 is a similar view showing the same in operation.

FIGS. 18 to 20 show another example of means for retaining the spool member 31. A base plate 92 is formed with a pair of vertically elongated guide grooves 93. A slider 95 having a guide roller 94 fitting in the guide groove 93 is provided with a roller bearing 96. The slider 95 is biased by a spring 97 into pressing contact with a stopper 98, whereby the roller bearing 96 is held fitted in the circumferential groove 49 in contact with the flange member 50. Thus, the spool member 31 is prevented from slipping off under the action of a thrust force, in the same manner as already described.

When a U-shaped member 99 is forced upward by the pusher 83, the roller bearings 96 are removed from the flange member 50 against the springs 97 as shown in FIG. 19, rendering the spool member 31 withdrawable by the hook member 76.

The means shown in FIGS. 18 to 20 is simpler in construction and more lightweight than the retaining means comprising link means and already described. The rolling-up apparatus which is rotated and stopped in synchronism with the knitting machine can therefore be stopped in position more reliably because the above arrangement results in a reduced force of inertia.

Figures 21, 23:
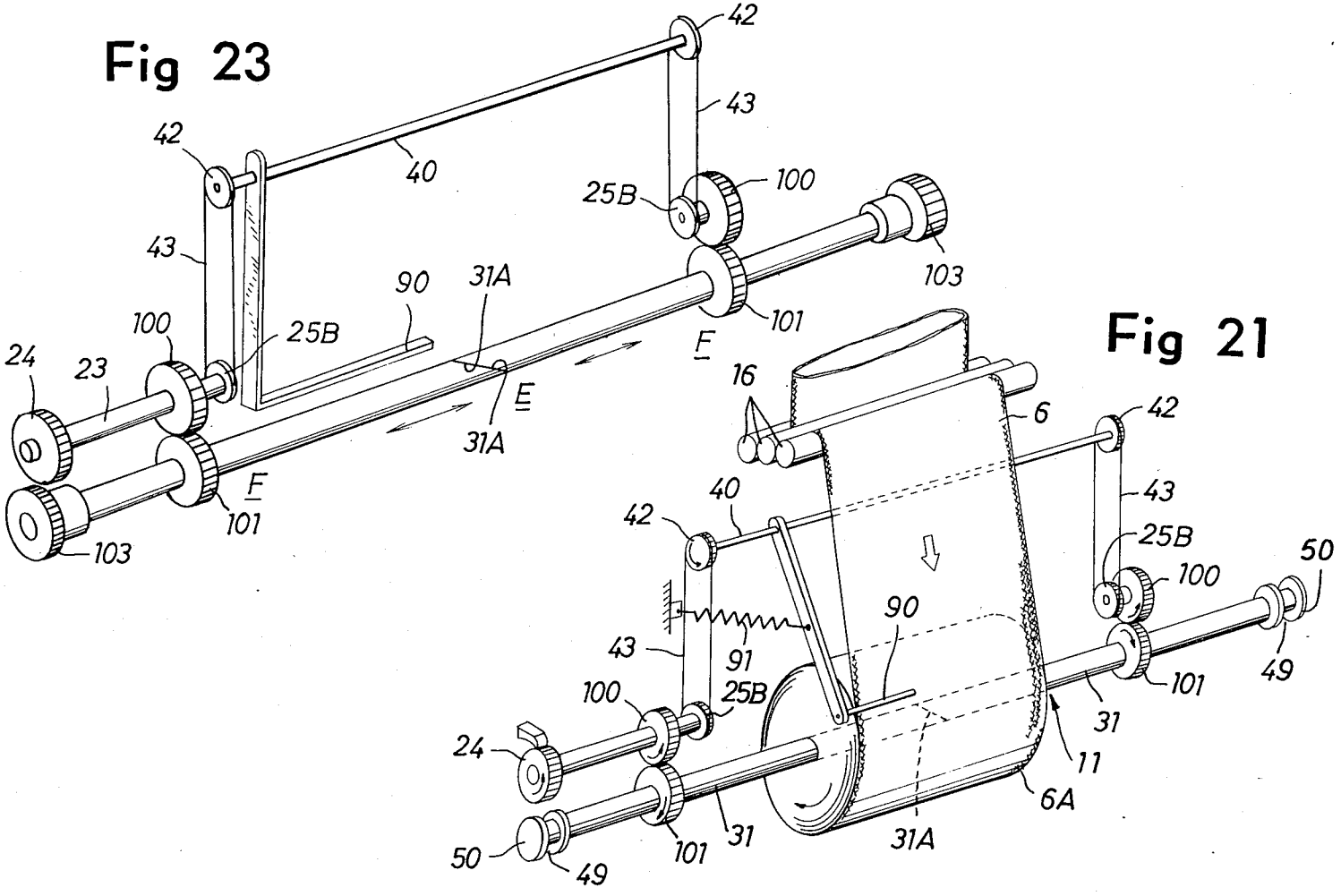
FIG. 21 is a perspective view showing the fabric being rolled up.
FIG. 23 is a perspective view schematically showing another embodiment of fabric rolling-up apparatus.
Figure 22:
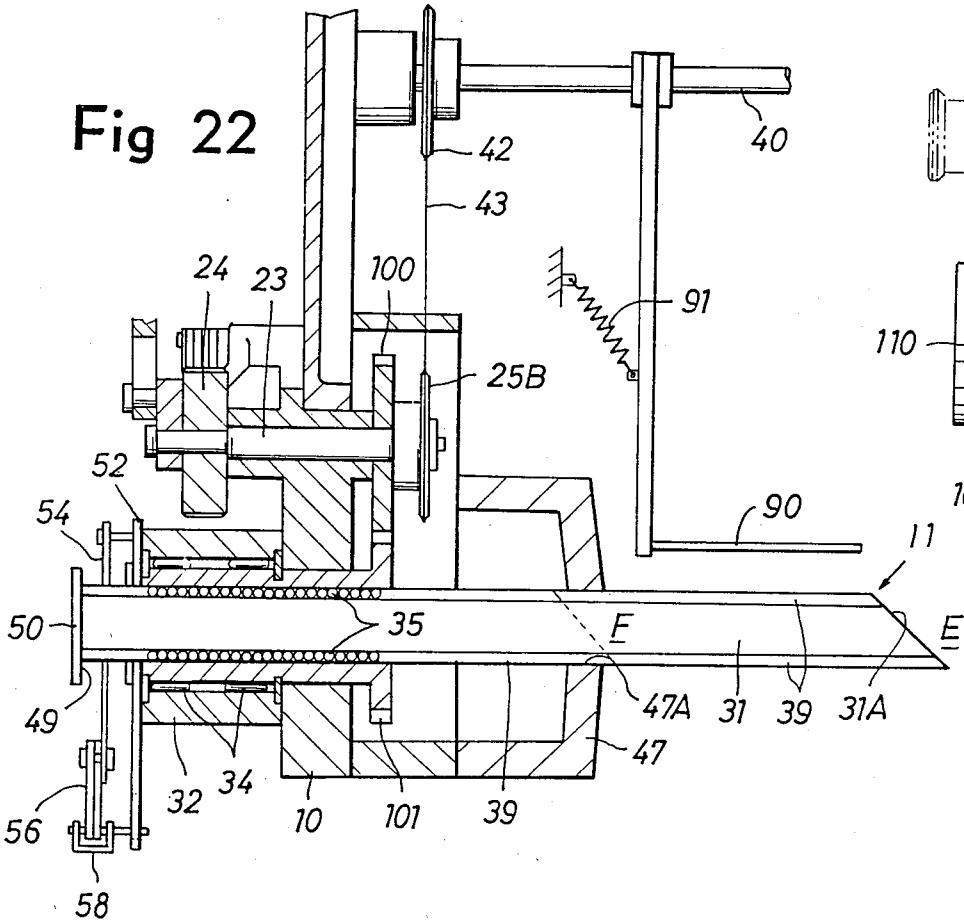
FIG. 22 is a front view showing the main portion of FIG. 21 in section.

Although the torque transmission means for the take-up shaft 11, i.e. the pair of opposed spool members 31, already described is a wrapping connector driving system, FIGS. 21 and 22 show transmission means comprising spur gears 100 and 101 meshing with each other. With the exception of this feature, the latter means has the same construction as the foregoing, so that like parts are referred to by like reference numerals throughout the drawings concerned.

Since the wrapping connector driving differs from the gear transmission in the direction of rotation, the direction of torque transmission by the drive pawl 28 to the intermediate transmission shaft is reversed relative to the direction of the foregoing case.

Figure 24:
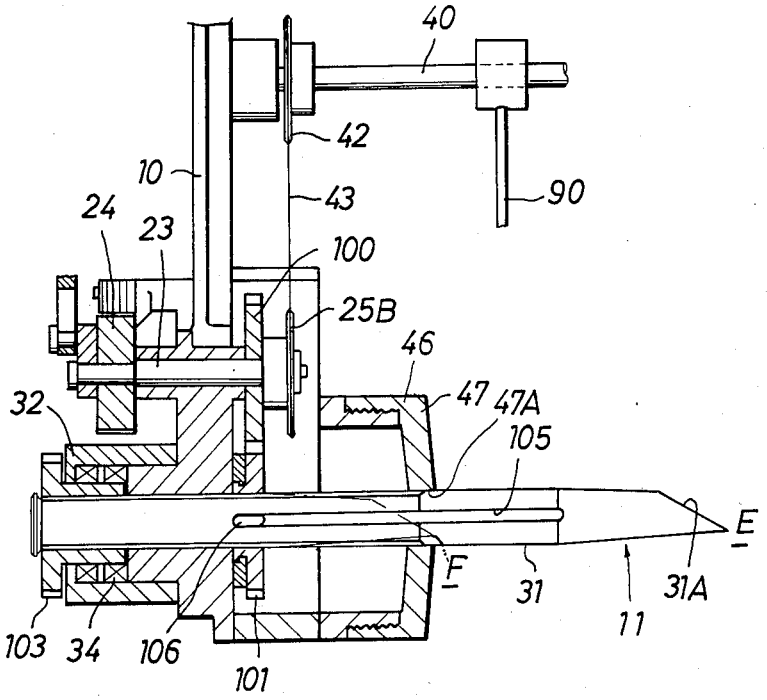
FIG. 24 is a framentary front view in section showing the same.
Figure 25:
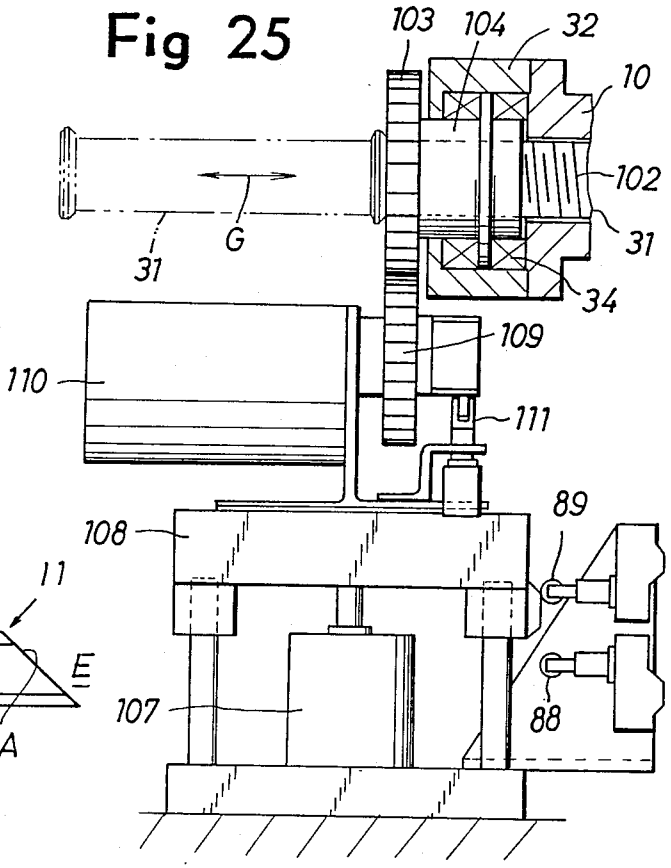
FIG. 25 is a front view partly in section and showing the spool withdrawing means included in the embodiment of FIG. 23.

FIGS. 23 to 25 show an embodiment wherein the transmission means for the take-up spool 11 comprises spur gears 100 and 101, and each spool member 31 is movable forward or rearward axially thereof by screw drive means.

Each of the spool members 31 has a screw portion 102 extending from its base end to the projecting end over a length corresponding to the distance of axial movement of the spool member. An end gear 103 is rotatably supported by bearings 34 on the support frame 10. The screw portion 102 of the spool member 31 extends through the boss portion 104 of the end gear 103 in screw-thread engagement therewith.

A key 106 is engaged in a key groove 105 formed in the spool member 31 for torque transmission from the gear 101 to the spool member 31. This engagement also guides the spool member 31 for its axial movement.

With reference to FIG. 25, a lift table 108 is movable upward or downward by lift drive means 107 such as a cylinder or motor. A drive gear 109 mounted on the lift table 108 is reversibly rotatable by a motor 110. When the fabric has been fully rolled up on the take-up spool 11, the lift table 108 is raised to bring the drive gear 109 into meshing engagement with the end gear as seen in FIG. 25, and the motor 110 is started to rotate the gear 103 and withdraw the spool member 31 in the direction of arrow G by screw drive. When the motor 110 is reversely rotated, the spool member 31 is advanced to the rolling-up position E. The motor 110 is driven according to the count provided by a switch 111.

The withdrawing means shown in FIG. 25 has the advantage that it can be installed compactly in a specified portion of the knitting machine without the necessity for a swiveling function.

However, since the thrust force acting on the spool member 31 is delivered to the end gear 103 through the screw portion 102, the end gear 103 must be properly held in position to withstand the thrust force.

The fabric 6 formed by the knitting machine and hanging therefrom is rolled up first at its leading end and finally delivered in the form of a roll by the method to be described below with reference to the embodiment shown in FIGS. 1 to 22 although the method will be already apparent.

Figure 12:
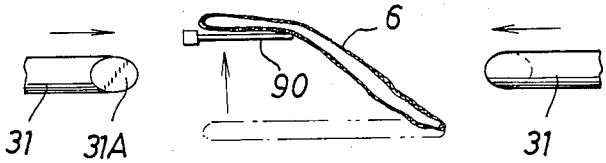

With the leading end of the fabric 6 positioned across the axis of the pair of spool members 31 as shown in FIG. 12, the spool members 31 are advanced to the rolling-up position, whereby the fabric 6 is clamped between the opposed ends of the members 31 from the opposite sides as seen in FIG. 13.

The spool members 31, when rotated in the rolling-up direction in this tate, continuously roll up the fabric 6 thereon.

During the rolling-up operation, the apparatus 1 is in rotation in synchronism with the knitting means of the machine 1, so that the fabric can be rolled up on the spool members 31, i.e. on the take-up spool 11, without twisting.

When the fabric 6 has been rolled up nearly to a full extent, the dolly 86 is positioned below the rolling-up position E, with the hook members 76 of the pair of opposed withdrawing means 62 held in position. The hook members 76 are then fitted into the circumferential grooves 49 of the flange members 50 in preparation for the withdrawal of the spool members 31.

With the flange members 50 subsequently released from the retaining means 48, the hook members 76 are moved in the direction of arrow G in FIG. 7 to axially shift the pair of spool members 31 from the rolling-up position E to the withdrawn position F, whereby the take-up spool 11 is withdrawn from the rolled-up fabric 6A.

As seen in FIG. 11, the fabric 6 is cut with the cutters 87, and the roll 6A is placed on the dolly 86 and delivered from the machine 1.

On the other hand, the withdrawn spool members 31 are advanced in a direction opposite to the arrow G and thereby shifted from the withdrawn position F to the rolling-up position E to clamp the leading end of the following portion of fabric for the subsequent rolling-up operation.

The present invention described above in detail results in the following advantages.

When the leading end of the tubular fabric hanging from the knitting means of the knitting machine is to be wound on the take-up spool, the end must be held to the spool by the winding force. For this purpose, the leading end as positioned across the axis of the spool can be clamped by the projecting ends of the pair of spool members to start rolling-up operation reliably with a reduced likelihood of damaging the fabric.

Since the take-up spool comprising the spool members is withdrawn from the rolled-up fabric by axially shifting the spool members from the rolling-up position to the withdrawn position, the rolled-up fabric carries no spool. This eliminates the need to stock a plurality of take-up spools.

The advantage that there is no need to stock take-up spools makes the rolling-up apparatus lightweight, reduces the force of inertia when the apparatus is to be stopped along with the knitting machine and assures a greatly improved rolling-up efficiency.

What is claimed is:

1. A fabric rolling-up apparatus for a circular knitting machine disposed below the knitting means of the machine and adapted to be brought into and out of operation in synchronism with the knitting means, the rolling-up apparatus having a pair of opposed support frames and a take-up spool supported by bearing means on the support frames and stoppably rotatable about a horizontal axis in a direction for rolling up thereon the knitted fabric delivered in a hanging state from the knitting means, the apparatus being characterized in that the take-up spool comprises a pair of spool members rotatable together on a common axis in the rolling-up direction by transmission means, each of the spool members having a projecting end providing a fabric clamping face, each spool member being supported on bearing means on the corresponding support frame and being axially movable between a rolling-up position and a withdrawn position outwardly away therefrom, retaining means being mounted on each of the support frames and engageable with the outer end of the spool member for preventing the spool member from moving outward, withdrawing means fixedly provided in opposed relationship to each other outside the knitting machine for axially moving the pair of spool members between the rolling-up position and the withdrawn position when the spool members are released from the retaining means; wherein each of the spool members is formed with axial grooves that are semicircular in cross section and arranged radially of the spool member, and balls are rollably fitted in the semicircular grooves, the balls and the semicircular grooves effecting transmission of torque for the rotation of the spool member in the rolling-up direction and guiding the axial movement of the spool member.

2. A machine according to claim 1, wherein the support frames are provided with bearing means for supporting the respective spool members and also have caps with through holes through which the spool members extend, wherein the caps serve as stopper means for ends of the wound fabric, and are axially adjustable for adjusting of the positioning thereof for winding of fabrics of different widths.

3. A fabric rolling-up apparatus for a circular knitting machine disposed below the knitting means of the machine and adapted to be brought into and out of operation in synchronism with the knitting means, the rolling-up apparatus having a pair of opposed support frames and a take-up spool supported by bearing means on the support frames and stoppably rotatable about a horizontal axis in a direction for rolling up thereon the knitted fabric delivered in a handing state from the knitting means, the apparatus being characterized in that the take-up spool comprises a pair of spool members rotatable together on a common axis in the rolling-up direction by transmission means, each of the spool members having a projecting end providing a fabric clamping face, each spool member being supported on bearing means on the corresponding support frame and being axially movable between a rolling-up position and a withdrawn position outwardly away therefrom, retaining means being mounted on each of the support frame and engageable with the outer end of the spool member for preventing the spool member from moving outward, withdrawing means fixedly provided in opposed relationship to each other outside the knitting machine for axially moving the pair of spool members between the rolling-up position and the withdrawn position when the spool members are released from the retaining means; wherein a flange portion having a circumferential groove is attached to the axially outer end of each spool member, and a pair of roller bearings is rollably in contact with the flange portion for retaining the spool member against axial movement, the apparatus further comprising expandable link means for removably holding the roller bearings in contact with the flange portion, each of the withdrawing means being provided with lift means for expanding or collapsing the link means and having a hook member engageable in the circumferential groove of the flange portion for axially moving the spool member.

4. An apparatus as defined in claim 3 wherein a hook member engageable in the circumferential groove of the flange portion is linearly, reciprocating movably mounted on a slider, and the slider is mounted on a swivel table swivelable about a vertical axis and provided on a fixed member outside the knitting machine, the hook member being engageable in and disengageable from the circumferential groove of the flange portion.

5. A fabric rolling-up apparatus for a circular knitting machine disposed below the knitting means of the machine and adapted to be brought into and out of operation in synchronism with the knitting means, the rolling-up apparatus having a pair of opposed support frames and a take-up spool supported by bearing means on the support frames and stoppably rotatable about a horizontal axis in a direction for rolling up thereon the knitted fabric delivered in a hanging state from the knitting means, the apparatus being characterized in that the take-up spool comprises a pair of spool members rotatable together on a common axis in the rolling-up direction by transmission means, each of the spool members having a projecting end providing a fabric clamping face, each spool member being supported on bearing means on the corresponding support frame and being axially movable between a rolling-up position and a withdrawn position outwardly away therefrom, retaining means being mounted on each of the support frame and engageable with the outer end of the spool member for preventing the spool member from moving outward, withdrawing means fixedly provided in opposed relationship to each other outside the knitting machine for axially moving the pair of spool members between the rolling-up position and the withdrawn position when the spool members are released from the retaining means; wherein a flange portion having a circumferential groove is attached to the axially outer end of each spool member, and a pair of roller bearings rollably fitted in the circumferential groove is provided on a vertically movable slider, the pair of roller bearings being engageable with or disengageable from the flange portion by the vertical movement of the slider to serve as the retaining means.

6. A fabric rolling-up apparatus for a circular knitting machine disposed below the knitting means of the machine and adapted to be brought into and out of operation in synchronism with the knitting means, the rolling-up apparatus having a pair of opposed support frames and a take-up spool supported by bearing means on the support frames and stoppably rotatable about a horizontal axis in a direction for rolling up thereon the knitted fabric delivered in a hanging state from the knitting means, the apparatus being characterized in that the take-up spool comprises a pair of spool members rotatable together on a common axis in the rolling-up direction by transmission means, each of the spool members having a projecting end providing a fabric clamping face, each spool member being supported on bearing means on the corresponding support frame and being axially movable between a rolling-up position and a withdrawn position outwardly away therefrom, retaining means being mounted on each of the support frame and engageable with the outer end of the spool member for preventing the spool member from moving outward, withdrawing means fixedly provided in opposed relationship to each other outside the knitting machine for axially moving the pair of spool members between the rolling-up position and the withdrawn position when the spool members are released from the retaining means; wherein each of the spool members has a screw portion, and a gear internally threaded and having the screw portion inserted therethrough in screw-thread engagement therewith is axially immovably mounted on the support frame at the outer end of the spool member, a gear being fixedly provided outside the knitting machine in opposed relation thereto for transmitting thereto a torque selectively for forward or reverse rotation, the gears being meshable with each other to axially move the spool member between the rolling-up position and the withdrawn position by screw drive.

7. A circular knitting machine comprising a rolling-up apparatus:

said rolling-up apparatus being disposed below a knitting means of the machine and adapted to be brought into and out of operation in synchronism with the knitting means, and being provided with a pair of opposed support frame, which support a take-up spool which is stoppably rotatable about a horizontal axis to wind knitted fabric delivered to the take-up spool from the knitting means;

wherein the take-up spool comprises a pair of spool members which are adapted to roll concurrently about a common aligned axis in a winding direction by transmission means;

wherein each spool member has a fabric clamping face at an inner end and is disposed to be axially transferable on the common aligned axis between an inner rolling-up position and a withdrawn position outwardly away therefrom;

wherein the respective clamping faces of the spool members are adapted to coact as a means for holding the knitted fabric therebetween in said rolling-up position;

wherein retaining means is provided at each support frame to removably engage with an outer end of the respective spool member for holding the spool member in the rolling-up position;

wherein withdrawing means is provided in opposed relationship to each other for axially moving the respective spool members between the rolling-up position and the withdrawn position when the spool members are released from the retaining means; and wherein said rolling-up apparatus further comprising a fabric shifting means for guiding a free-hanging fabric end portion to a position extending across the common aligned axis of the spool members from one side to another for enabling the fabric end to be clamped by the clamping faces of the spool members.

8. A machine according to claim 7, wherein said clamping faces are formed by tapering end portions of the spool members.

9. A machine according to claim 8 wherein the fabric shifting means comprises a spring biased member which contacts the fabric during rolling and follows diametric changes of the wound fabric.

10. A machine according to claim 9, wherein said spring biased member includes an elongated fabric contacting arm portion extending parallel to said takeup spool along only a portion of a winding surface of the takeup spool and at a position that is located, heightwise, between the knitting means and the take-up spool.

11. A machine according to claim 7, wherein the fabric shifting means comprises a spring biased member which contacts the fabric during rolling and follows diametric changes of the wound fabric.

12. A machine according to claim 11, wherein said spring biased member includes an elongated fabric contacting arm portion extending parallel to said take-up spool along only a portion of a winding surface of the takeup spool and at a position that is located, heightwise, between the knitting means and the take-up spool.

13. A fabric rolling-up method for a circular knitting machine wherein a rolling-up apparatus is disposed below a knitting means of the machine and is adapted to be brought into and out of operation in synchronism with the knitting means, and wherein the rolling-up apparatus comprises a pair of opposed support frames which support a take-up spool which is stoppably rollable about a horizontal axis to wind knitted fabric delivered to the take-up spool from the knitting means and wherein the take-up spool comprises a pair of spool members which are adapted to roll concurrently about a common aligned axis in a winding direction by transmission means;

said rolling-up method comprising:

guiding a free-hanging fabric end across the common aligned axis while the spool members are at respective outwardly withdrawn positions relative to each other, and clamping the free-hanging fabric end at opposite sides thereof by transferring the spool members inwardly toward each other into a rolling-up position; winding the fabric onto the spool members by rolling the spool members with the fabric end clamped therebetween; slowing down winding of the fabric by synchronism of the rolling-up apparatus and the knitting means to stop the apparatus at a predetermined point; withdrawing the respective spool members out of the wound fabric into respective withdrawn positions by withdrawing means; and transferring the wound fabric out of the machine without the take-up spool.

14. A method according to claim 13, wherein the wound fabric is received on a dolly disposed below the rolling-up apparatus during said transferring step.

* * * * *